US009514715B2

(12) United States Patent
Hurd

(10) Patent No.: US 9,514,715 B2
(45) Date of Patent: Dec. 6, 2016

(54) GRAPHICS VOLTAGE REDUCTION FOR LOAD LINE OPTIMIZATION

(71) Applicant: INTEL CORPORATION, Santa Clara, CA (US)

(72) Inventor: Linda L. Hurd, Cool, CA (US)

(73) Assignee: Intel Corporation, Santa Clara, CA (US)

( * ) Notice: Subject to any disclaimer, the term of this patent is extended or adjusted under 35 U.S.C. 154(b) by 131 days.

(21) Appl. No.: 14/139,031

(22) Filed: Dec. 23, 2013

(65) Prior Publication Data

US 2015/0179146 A1 Jun. 25, 2015

(51) Int. Cl.
*G09G 5/36* (2006.01)

(52) U.S. Cl.
CPC ..... *G09G 5/363* (2013.01); *G09G 2330/025* (2013.01); *G09G 2360/06* (2013.01)

(58) Field of Classification Search
CPC ... G06F 1/3203; G06F 1/324; G09G 2330/021
USPC ..... 345/501; 713/300, 322
See application file for complete search history.

(56) References Cited

U.S. PATENT DOCUMENTS

| | | | |
|---|---|---|---|
| 5,953,020 | A | 9/1999 | Wang et al. |
| 6,172,550 | B1 | 1/2001 | Gold et al. |
| 7,337,339 | B1 | 2/2008 | Choquette et al. |
| 7,386,737 | B2 | 6/2008 | Finkelstein et al. |
| 7,574,613 | B2 | 8/2009 | Holle et al. |
| 7,634,668 | B2 | 12/2009 | White et al. |
| 7,664,971 | B2 | 2/2010 | Oh |
| 7,882,369 | B1 | 2/2011 | Kelleher et al. |
| 7,886,164 | B1 * | 2/2011 | Alben ..... G06F 1/3203 713/300 |
| 8,099,618 | B2 | 1/2012 | Vorbach et al. |
| 8,193,831 | B1 | 6/2012 | Kadosh et al. |

(Continued)

FOREIGN PATENT DOCUMENTS

WO 2013/101829 A1 7/2013

OTHER PUBLICATIONS

International Search Report and Written Opinion received for PCT Patent Application No. PCT/US2012/071653, mailed on Apr. 29, 2013, 10 pages.

(Continued)

*Primary Examiner* — Zhengxi Liu
*Assistant Examiner* — Yanna Wu
(74) *Attorney, Agent, or Firm* — Garrett IP

(57) ABSTRACT

Technologies are presented that optimize graphics power-performance efficiency. A method of graphics processing may include beginning a graphics workload with a first voltage and a first clamping threshold; monitoring amounts of time that bursts of dynamic capacitance remain above the first clamping threshold; and, if the dynamic capacitance remains above the first clamping threshold for more than a predetermined time threshold, setting the voltage to a second voltage and setting the clamping threshold to a second clamping threshold until the end of the frame. If, at the end of an initial frame, a number of clock cycles from a start of the frame to when the predetermined time threshold is exceeded is less than a predetermined minimum number of clock cycles, the second clamping threshold and the second voltage may be maintained for processing of a predetermined number of subsequent frames.

19 Claims, 9 Drawing Sheets

(56) References Cited

U.S. PATENT DOCUMENTS

| | | | | |
|---|---|---|---|---|
| 8,214,663 | B2 | 7/2012 | Floyd et al. | |
| 8,250,394 | B2 | 8/2012 | Agrawal | |
| 8,335,941 | B2 | 12/2012 | Chang et al. | |
| 8,539,269 | B2 | 9/2013 | Rotem et al. | |
| 9,122,632 | B2 | 9/2015 | Hurd | |
| 9,164,931 | B2 | 10/2015 | Hurd et al. | |
| 9,218,045 | B2 | 12/2015 | Hurd | |
| 2001/0011356 | A1 | 8/2001 | Lee et al. | |
| 2001/0029556 | A1 | 10/2001 | Priem et al. | |
| 2002/0002077 | A1 | 1/2002 | Shimizu et al. | |
| 2002/0019949 | A1 | 2/2002 | Meynard | |
| 2002/0169990 | A1 | 11/2002 | Sherburne, Jr. | |
| 2002/0178808 | A1 | 12/2002 | Hafer | |
| 2003/0007394 | A1 | 1/2003 | Phi et al. | |
| 2003/0115428 | A1 | 6/2003 | Zaccarin et al. | |
| 2005/0154931 | A1 | 7/2005 | Oh | |
| 2005/0289377 | A1 | 12/2005 | Luong et al. | |
| 2006/0047987 | A1 | 3/2006 | Prabhakaran et al. | |
| 2006/0053326 | A1 | 3/2006 | Naveh et al. | |
| 2006/0069936 | A1 | 3/2006 | Lint et al. | |
| 2006/0161799 | A1 | 7/2006 | Degenhardt | |
| 2006/0259804 | A1 | 11/2006 | Fry | |
| 2007/0206683 | A1* | 9/2007 | Lin | H04N 21/44004 375/240.25 |
| 2007/0208964 | A1 | 9/2007 | Sandon et al. | |
| 2007/0234075 | A1 | 10/2007 | Zimmer et al. | |
| 2007/0245165 | A1 | 10/2007 | Fung | |
| 2008/0001795 | A1 | 1/2008 | Arabi | |
| 2008/0005592 | A1 | 1/2008 | Allarey et al. | |
| 2008/0235364 | A1 | 9/2008 | Gorbatov et al. | |
| 2008/0244294 | A1 | 10/2008 | Allarey et al. | |
| 2008/0307248 | A1 | 12/2008 | Amano et al. | |
| 2009/0001814 | A1 | 1/2009 | Subramaniam | |
| 2009/0204830 | A1 | 8/2009 | Frid et al. | |
| 2010/0082943 | A1 | 4/2010 | Yamamoto | |
| 2010/0115304 | A1 | 5/2010 | Finkelstein et al. | |
| 2010/0169692 | A1 | 7/2010 | Burton | |
| 2010/0218029 | A1 | 8/2010 | Floyd et al. | |
| 2010/0274938 | A1 | 10/2010 | Anand et al. | |
| 2011/0022871 | A1 | 1/2011 | Bouvier et al. | |
| 2011/0093724 | A1 | 4/2011 | Park et al. | |
| 2011/0099397 | A1 | 4/2011 | Rotem et al. | |
| 2011/0138388 | A1 | 6/2011 | Wells et al. | |
| 2011/0145617 | A1 | 6/2011 | Thomson et al. | |
| 2011/0154081 | A1 | 6/2011 | Allarey | |
| 2011/0154348 | A1 | 6/2011 | Elnozahy et al. | |
| 2011/0161627 | A1 | 6/2011 | Song et al. | |
| 2011/0161683 | A1 | 6/2011 | Zou et al. | |
| 2011/0173477 | A1 | 7/2011 | Asaba | |
| 2011/0238974 | A1 | 9/2011 | Wells et al. | |
| 2011/0267079 | A1* | 11/2011 | Gecnuk | H03K 17/955 324/658 |
| 2012/0095442 | A1 | 4/2012 | Dormer et al. | |
| 2012/0110352 | A1 | 5/2012 | Branover et al. | |
| 2012/0166838 | A1 | 6/2012 | Nasrullah et al. | |
| 2012/0169746 | A1* | 7/2012 | Samson | G09G 5/363 345/520 |
| 2012/0254643 | A1* | 10/2012 | Fetzer | G06F 1/324 713/320 |
| 2013/0007413 | A1 | 1/2013 | Thomson et al. | |
| 2013/0015904 | A1 | 1/2013 | Priel et al. | |
| 2013/0097443 | A1 | 4/2013 | Li et al. | |
| 2013/0101189 | A1 | 4/2013 | Robitaille et al. | |
| 2013/0275782 | A1 | 10/2013 | Svilan et al. | |
| 2014/0002467 | A1 | 1/2014 | Hurd | |
| 2014/0006838 | A1 | 1/2014 | Hurd | |
| 2014/0085501 | A1 | 3/2014 | Tran | |
| 2014/0089699 | A1 | 3/2014 | O'Connor et al. | |
| 2014/0092106 | A1 | 4/2014 | Hurd et al. | |
| 2014/0095906 | A1 | 4/2014 | Hurd | |
| 2014/0095912 | A1 | 4/2014 | Hurd et al. | |
| 2014/0237272 | A1 | 8/2014 | Sadowski et al. | |
| 2014/0245034 | A1 | 8/2014 | Rotem et al. | |
| 2015/0179146 | A1 | 6/2015 | Hurd | |

OTHER PUBLICATIONS

Office Action received for Korean Patent Application No. 10-2014-0164661, mailed on Oct. 19, 2015, 5 pages of English Translation and 5 pages of Korean Office Action.

Office Action received for U.S Appl. No. 13/340,129, mailed on Dec. 13, 2013, 11 pages.

Final Office Action received for U.S. Appl. No. 13/539,411 mailed on Jan. 15, 2015, 17 pages.

Notice of Allowance received for U.S. Appl. No. 13/539,411, mailed on Aug. 28, 2015, 8 pages.

Office Action received for U.S. Appl. No. 13/539,411, mailed on Jul. 2, 2014, 21 pages.

Final Office Action received for U.S. Appl. No. 13/539,414 mailed on Nov. 10, 2014, 12 pages.

Notice of Allowance received for U.S. Appl. No. 13/539,414, mailed on Apr. 24, 2015, 10 pages.

Office Action received for U.S. Appl. No. 13/539,414 mailed on Jul. 16, 2014, 11 pages.

Office Action received for U.S. Appl. No. 13/631,913 mailed on Nov 7, 2014, 15 pages.

Non-Final Office Action received for U.S. Appl. No. 14/139,031, mailed on Nov. 2, 2015, 20 pages.

International Preliminary Report on Patentability with Written Opinion received for PCT Application No. PCT/US2011/068120, mailed on Jul. 10, 2014, 6 pages.

International Search Report and Written Opinion received for PCT Application No. PCT/US2011/068, mailed on Sep. 21, 2012, 9 pages.

International Preliminary Report on Patentability and Written Opinion received for PCT Application No. PCT/US2012/071653, mailed on Jul. 10, 2014, 7 pages.

International Search Report and Written Opinion received for PCT Patent Application No. PCT/US2012/071653 mailed on Apr. 29, 2013, 10 pages.

* cited by examiner

GRAPHICS VOLTAGE REDUCTION FOR LOAD LINE OPTIMIZATION

TECHNICAL FIELD

The technologies described herein generally relate to frame-based threshold metrics for graphics power-performance efficiency improvement.

BACKGROUND

In graphics processing, one challenge is optimizing performance versus power usage, particularly at frame start. Previous solutions that do not use maximum dynamic capacitance clamping use full, or near full, power. When using maximum dynamic capacitance clamping, a clamping threshold may be used. A clamping threshold is a ceiling that allows the lowering of worst case current that may go through a load line. The clamping threshold may be statically or dynamically set. The choice between setting a clamping threshold statically or dynamically may be based on operating points (e.g., voltage, frequency, maximum supply current limit, etc.). For aggressive dynamic clamping, there may be an increase in frame length clock count, which would need to be offset by an equal or greater frequency increase for net frame rate return on investment that is greater than or equal to zero. These solutions do not utilize intra-frame knowledge of a workload's activity behavior.

BRIEF DESCRIPTION OF THE DRAWINGS/FIGURES

Figure 1:
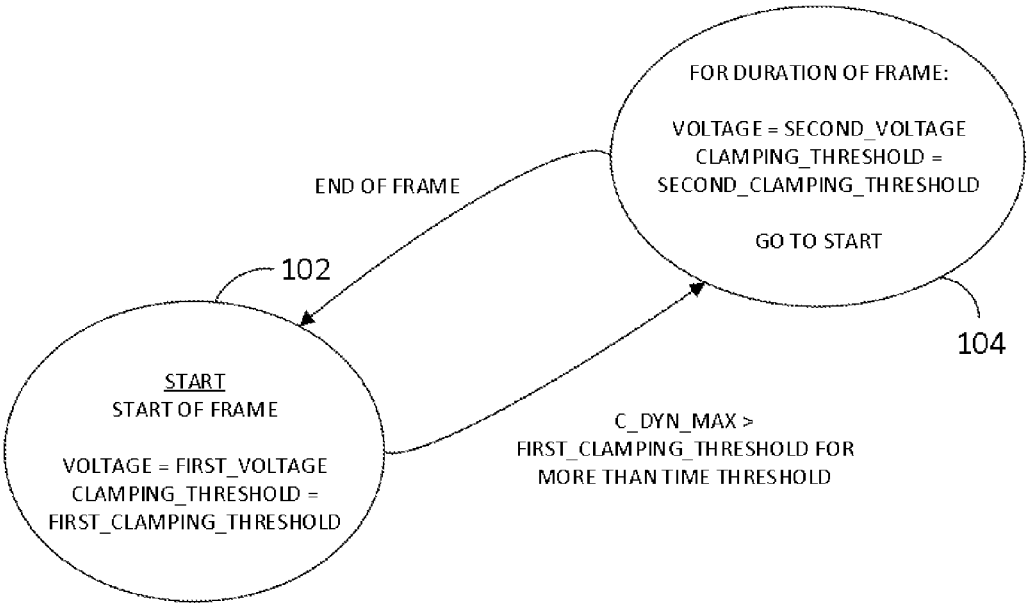
FIG. 1 is a state diagram depicting a voltage alignment method for graphics load line optimization, according to an embodiment.

In the drawings, the leftmost digit(s) of a reference number may identify the drawing in which the reference number first appears.

DETAILED DESCRIPTION

The term maximum dynamic capacitance (Cdyn_max) generally refers to the maximum amount of dynamic capacitance (Cdyn) that an integrated circuit component or package can sustain across a defined window of time. Graphics architecture is relatively complex. For example, the maximum sustainable dynamic capacitance for 1 μsec may be a different value than that for 100 μsec or 2 μsec based on the complexity of the different subsystems, latencies, and interactions between these subsystems. Accordingly, controlling the value of Cdyn_max may have a direct effect on power-efficiency and/or speed of graphics components. Thus, clamping (or reduction) of maximum dynamic capacitance may positively impact power and performance efficiency of graphics workloads.

The amount of power reduction possible for a graphics workload may be dependent upon multiple factors including, for example, fabrication material (e.g., fast materials may have high leakage current), frequency (e.g., the higher the frequency, the more power may be needed), and temperature (e.g., the higher the temperature, the higher the leakage). Another factor may include the percentage of frame length that may be eligible for voltage reduction. Clamping of Cdyn_max may assist in identifying an opportunity at the start of a graphics frame to reduce graphics voltage for load line optimization. This opportunity may lie, for example, from the start of a frame (when graphics pipelines are empty or flushed) to when a given number of clock cycles has high activity. A reduction in graphics voltage during this window may provide both power reduction and increased power-performance efficiency.

A graphics frame can be a two-dimensional (2D) frame having x pixel by y pixel dimensions and that depicts 2D or three-dimensional (3D) graphics. At the start of a graphics frame, the graphics pipelines are flushed. There is no active work in the pipelines, which may indicate that graphics is momentarily idle. Once work begins entering into the graphics interface, it takes time for the pipelines to fill. This work trickles through geometry preprocessing, which then dispatches threads to the EUs (computational units). The EUs may then send work to the texture sampler. During this time, as pipelines are filling, the graphics Cdyn may be significantly low. This low level of activity may be monitored by using Cdynmax clamping as described above. As long as the activity level remains low, graphics may use a lower voltage and a Cdynmax clamping threshold set to a lower level without performance degradation, which may result in improved power-performance efficiency. Supplied voltage needs to be designed for a worst case load and current. Thus, a higher voltage, and less aggressive clamping threshold, may be requested and set when it is detected that graphics activity has increased to a sustained higher level.

As an example, a graphics workload may start with a voltage of 0.70 v (voltage_0) and a clamping threshold of 55% (clamping_threshold_0). In addition, a preset allowable burst length may be set to, for example, ~50 μsec. The preset allowable burst length is a predetermined threshold representing the largest burst of dynamic capacitance that will have little to no impact on graphics performance.

In this example, knowledge of frame start and end may be necessary. In an embodiment, a "start of frame" marker may be generated by a driver, and communicated to graphics and/or the power control unit (PCU). In another embodiment, graphics may have internal logical detection of start of frame based on conditions such as, for example: all major graphics subsystems are idle for X clocks, all major subsystems excluding the graphics interface are idle for Y clocks, etc. An end of frame marker may also be generated. It is important to know when a frame begins and/or ends so that the voltage and clamping threshold may be reset prior to the start of a next frame. For example, if Duty Cycle Control (DCC) is used, before RC6 is entered at the end of a frame, graphics may reset the voltage to voltage_0 and the clamping threshold to clamping_threshold_0, such that when RC6 is exited, the PCU may apply voltage_0 and clamping_threshold_0 for the start of the next frame, as will be discussed below.

At the start of each graphics frame, graphics may be in a very low activity state (e.g., less than 50% of Cdyn_max. A Cdyn_max metric may be monitored in conjunction with Cdyn_max clamping. The voltage may be allowed to remain at voltage_0 until activity is sustained (i.e., Cdyn_max remains above clamping_threshold_0) for more than the preset allowable burst length. For short bursts of activity (in this example, less than 50 μsec), excursions are prevented from occurring by the clamping mechanism, with little to no loss of performance. However, if activity is sustained for more than the preset allowable burst length, graphics may request (e.g., to a driver and/or PCU) that voltage be increased to voltage_1 (e.g., 0.72 v). Once a response is received (e.g., PCU acknowledges that the voltage was increased to voltage_1), the clamping threshold may be increased to clamping_threshold_1 (e.g., 75%). The voltage and clamping threshold may remain at voltage_1 and clamping_threshold_1 for the remainder of the frame. At the end of the frame, the clamping threshold is returned to clamping_threshold_0 (e.g., by graphics) and the voltage is returned to voltage_0 (e.g., by the driver or PCU) for the start of the next frame. In an embodiment, in the event that activity ramps up too quickly (e.g., Cdyn_max remains above clamping_threshold_0 for more than the preset allowable burst length within a predetermined number of clock cycles from the start of frame), the voltage and the clamping threshold may be set to voltage_1 and clamping_threshold_1 for a number of subsequent frames to account for early high activity.

FIG. 1 is a state diagram depicting an example voltage alignment method for graphics load line optimization, according to an embodiment. The state diagram summarizes the method described above. At 102, the start of a frame of a graphics workload, a voltage is equal to a first voltage, and a clamping threshold is equal to a first clamping threshold. If during monitoring of Cdyn_max, it is determined that Cdyn_max exceeded the first clamping threshold for more than a given time threshold, the state moves to 104, where, for the duration of the frame, the voltage is increased to a second voltage, and the clamping threshold is increased to a second clamping threshold. At the end of the frame, the state returns to 102, where, at the start of the next frame, the voltage is again equal to the first voltage and the clamping threshold is again equal to the first clamping threshold. This may continue until the end of the graphics workload.

Figure 2:
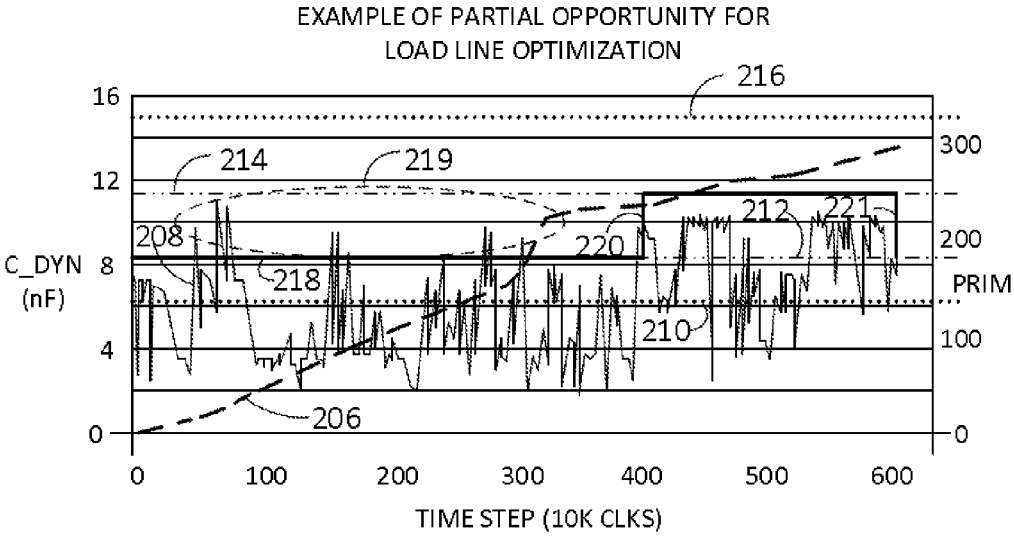
FIG. 2 is an example graph showing partial opportunity for graphics load line optimization, according to an embodiment.

FIG. 2 is an example graph showing partial opportunity for graphics load line optimization, according to an embodiment. In FIG. 2, plot 206 shows primitive number versus time step, and plot 208 shows dynamic capacitance versus time step. Dotted line 210 shows the average Cdyn_max metric. Dashed line 212 shows a lower dynamic capacitance clamping threshold and dashed line 214 shows a higher dynamic capacitance clamping threshold. Dotted line 216 shows a 100% Cdyn_max metric. Line 218 shows the settings of the clamping threshold. In the first 66% of the frame, the clamping threshold is set equal to the lower clamping threshold. As can be seen circled by 219, there were various short burst excursions that were clamped. Sustained excursions are shown starting at around 4 million clocks, at which time the clamping threshold is increased to the higher clamping threshold (denoted by 220). The clamping threshold remains at the higher clamping threshold until the end of the frame (denoted by 221). This example shows a partial opportunity (of about 66%) for load line optimization.

Figure 3:
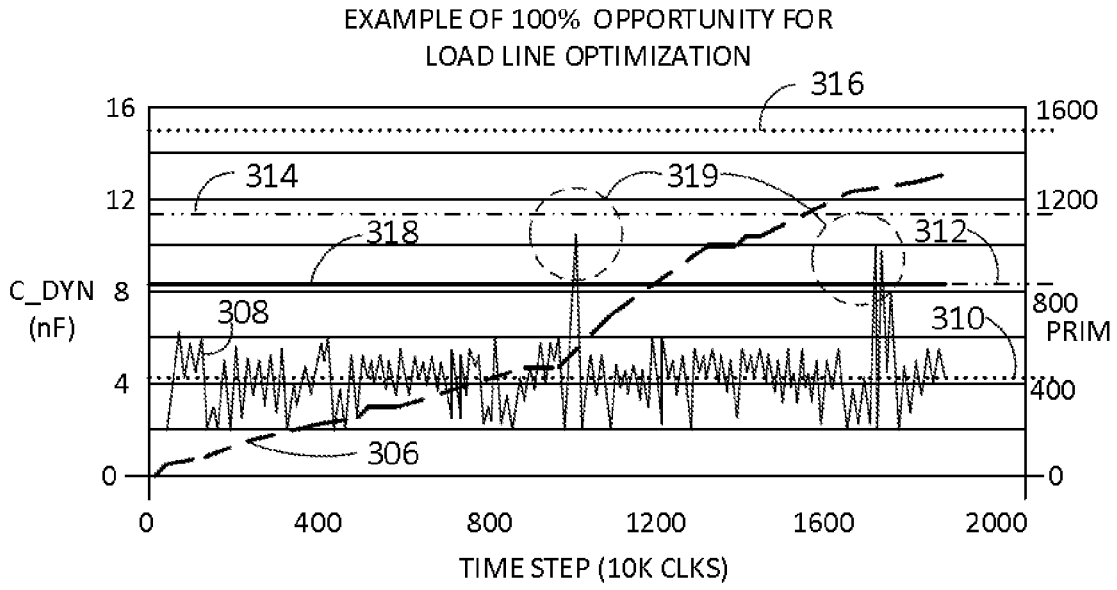
FIG. 3 is an example graph showing 100% opportunity for graphics load line optimization, according to an embodiment.

FIG. 3 is an example graph showing 100% opportunity for graphics load line optimization, according to an embodiment. In FIG. 3, plot 306 shows primitive number versus time step, and plot 308 shows dynamic capacitance versus time step. Dotted line 310 shows the average Cdyn_max metric. Dashed line 312 shows a lower dynamic capacitance clamping threshold and dashed line 314 shows a higher dynamic capacitance clamping threshold. Dotted line 316 shows a 100% Cdyn_max metric. Line 318 shows the setting of the clamping threshold. As can be seen, the clamping threshold is set equal to the lower clamping threshold for the entire duration of the frame. As can be seen circled by 319, there were some short burst excursions that were clamped. Sustained excursions never occur in this example, showing 100% opportunity for load line optimization.

Figure 4:
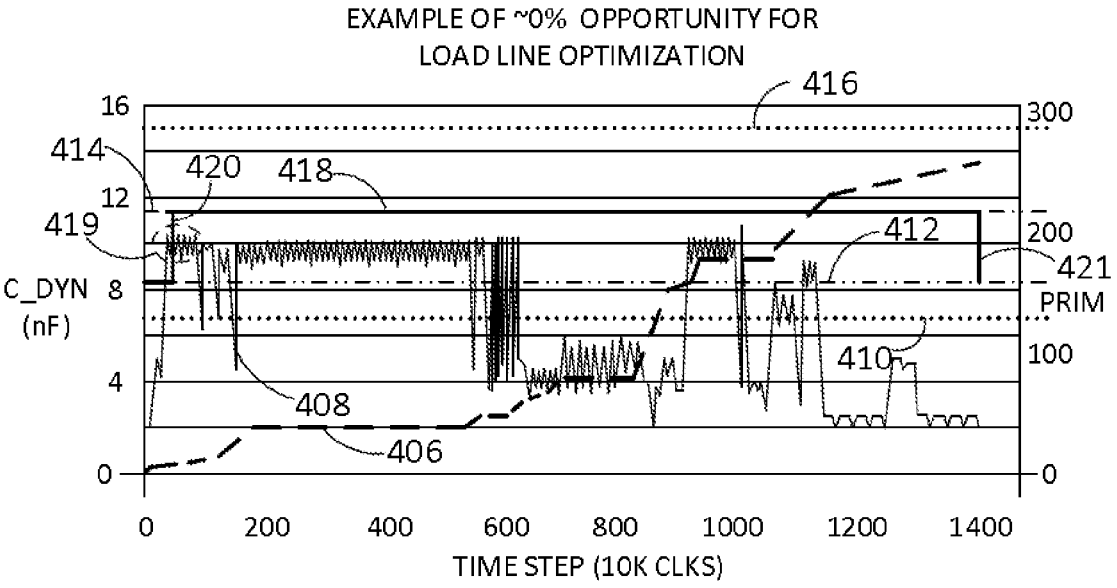
FIG. 4 is an example graph showing little opportunity for graphics load line optimization, according to an embodiment.

FIG. 4 is an example graph showing little opportunity for graphics load line optimization, according to an embodiment. In FIG. 4, plot 406 shows primitive number versus time step, and plot 408 shows dynamic capacitance versus time step. Dotted line 410 shows the average Cdyn_max metric. Dashed line 412 shows a lower dynamic capacitance clamping threshold and dashed line 414 shows a higher dynamic capacitance clamping threshold. Dotted line 416 shows a 100% Cdyn_max metric. Line 418 shows the settings of the clamping threshold. In the first ~2% of the frame, the clamping threshold is set equal to the lower clamping threshold. As can be seen circled by 419, sustained excursions occur early in the frame (starting at around 200K clocks, at which time the clamping threshold is increased to the higher clamping threshold (denoted by 420). The clamping threshold remains at the higher clamping threshold until the end of the frame (denoted by 421). This example shows little opportunity for load line optimization. This frame may be a candidate for disabling the load line optimization feature for a predetermined number of subsequent frames, as discussed above, to account for early high activity.

Figure 5A:
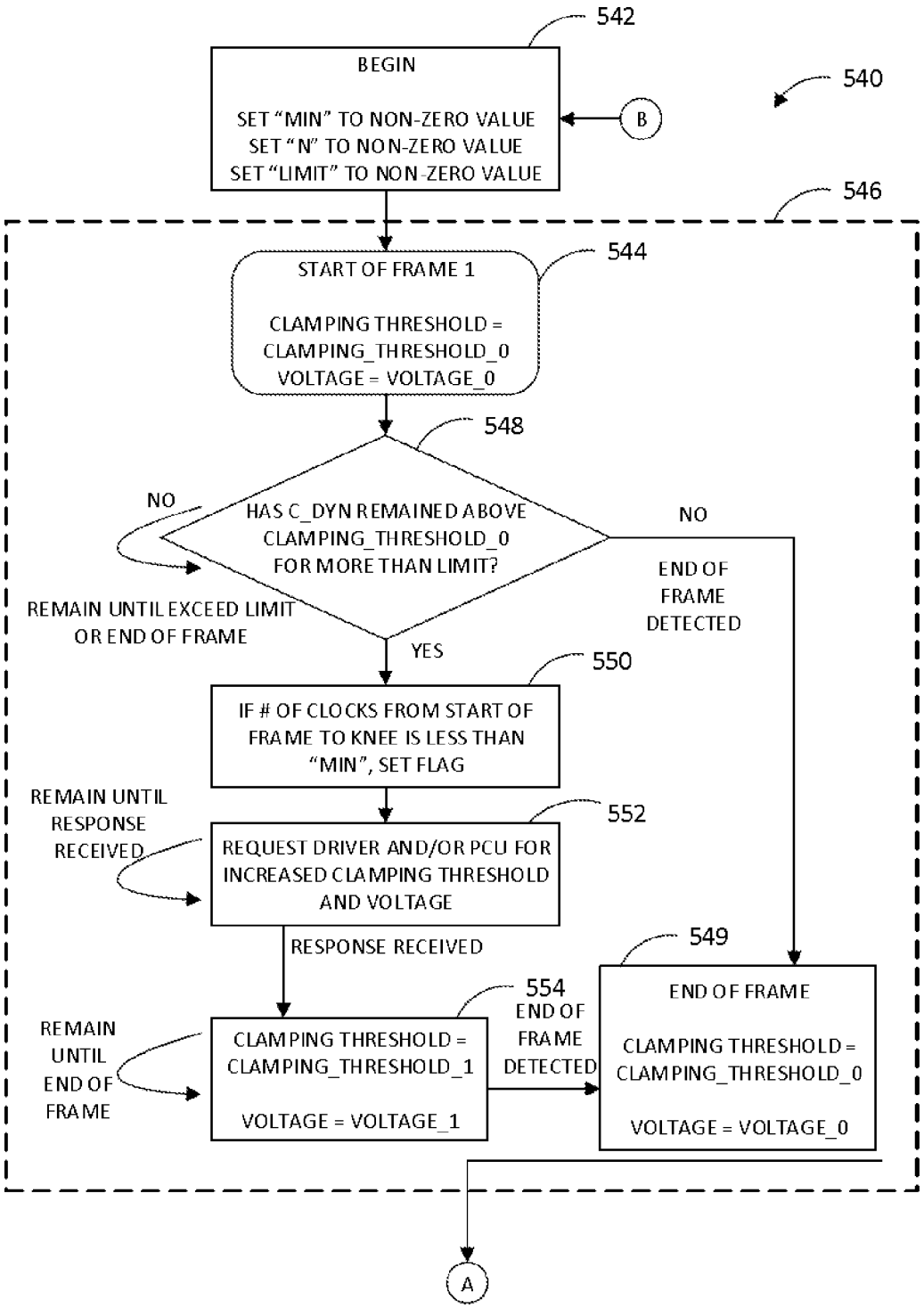
FIGS. 5A and 5B depict an example flow chart of a method of load line optimization in a graphics system, according to an embodiment.
Figure 5B:
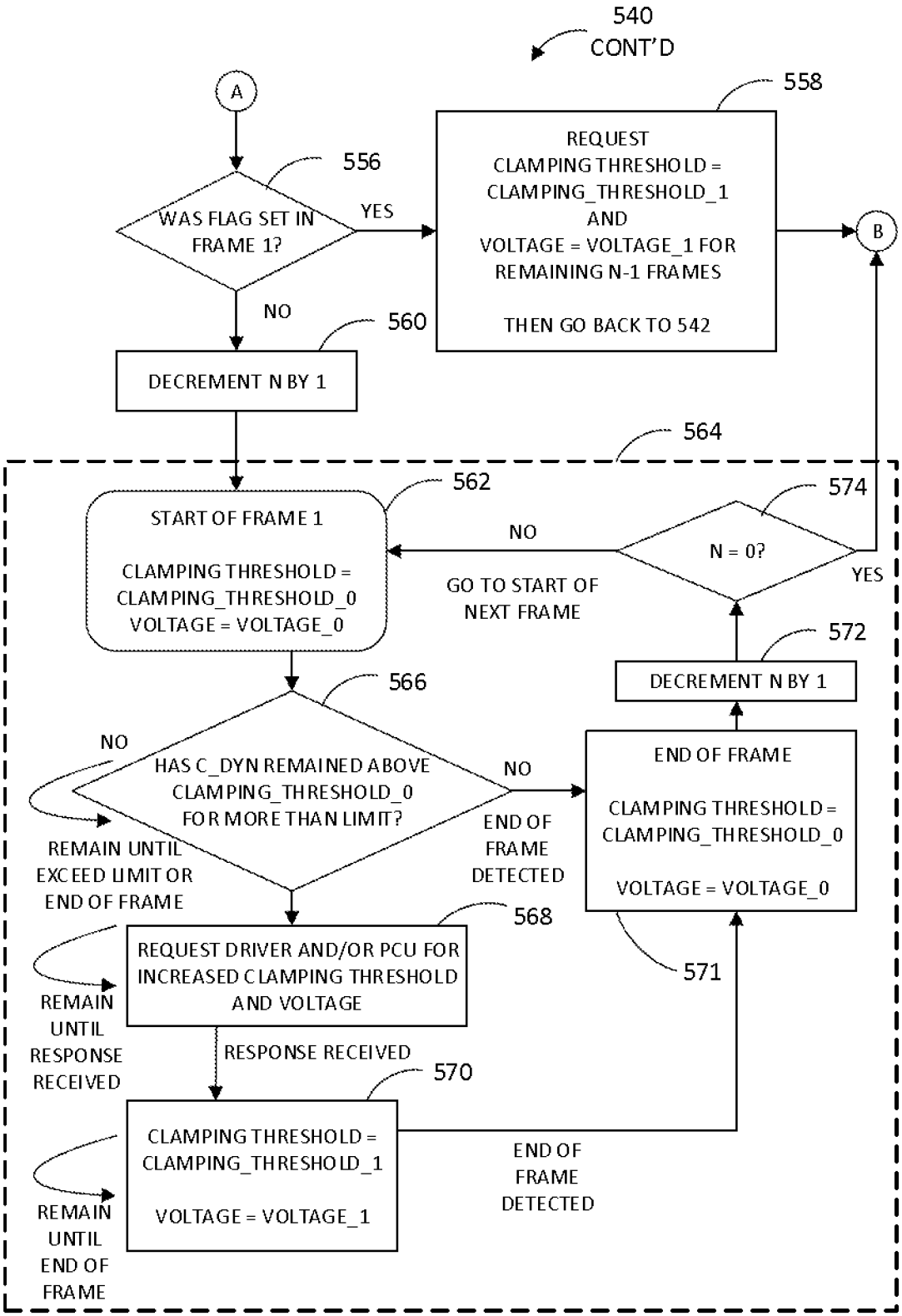

FIGS. 5A and 5B depict an example flow chart 540 of a method of load line optimization in a graphics system, according to an embodiment. At 542, variables "MIN", "N", and "LIMIT" may be set to non-zero values. "N" may represent a predetermined number of frames. The value chosen for "N" may depend on the workload. For example, if the workload has few scene changes, then "N" may be set higher, whereas if the workload has many (e.g., frequent) scene changes, then "N" may be set lower. Thus, "N" may be set to a value that makes sense for characteristics of a particular workload. "MIN" may represent a minimum number of clock cycles at which the load line optimization feature would be used at the start of each frame of the N frames. The value chosen for "MIN" may take into account the overhead (e.g., time) that it may take for power management control to "wake up" blocks of logic. "LIMIT" may represent a maximum amount of time that is acceptable for dynamic capacitance to remain above a clamping threshold without performance degradation. The value chosen for "LIMIT" may depend on what makes sense for characteristics of the hardware implementation of an architecture.

At 544, processing of the first frame of the N frames may begin, with a voltage set to voltage_0 and a clamping threshold set to clamping_threshold_0. Processing of the first frame of the N frames is denoted by the box designated as 546. At 548, it is determined whether the dynamic capacitance has remained above clamping_threshold_0 for more than the amount of time designated by "LIMIT". If not, and the end of frame is not detected, processing may remain at 548 until "LIMIT" is exceeded or the end of frame is detected. If not, and the end of frame is detected, processing may continue at 549 where the clamping threshold is set to clamping_threshold_0 and the voltage is set to voltage_0, if not already. Processing may continue at 556 in FIG. 5B.

Referring back to 548, if the "LIMIT" has been exceeded, processing may continue at 550, where a flag may be set if the number of clocks from the start of the frame to the point "LIMIT" was exceeded is less than "MIN". At 552, a request for increased voltage and clamping threshold may be requested from a driver and/or power control unit (PCU), where processing may remain until a response is received. Once a response is received, processing may continue at 554, where the clamping threshold may be increased to clamping_threshold_1 and the voltage may be increased to voltage_1 until the end of the frame. When the end of frame is detected, processing may continue at 549, where the clamping threshold is set to clamping_threshold_0 and the voltage is set to voltage_0. Processing may continue at 556 in FIG. 5B.

At 556, it may be determined whether the flag was set at 550. If so, processing continues at 558, where the voltage may be set to remain at voltage_1 and the clamping threshold may be set to remain at clamping_threshold_1 for the remaining N−1 frames, and processing may continue at 542 in FIG. 5A. If not, processing may continue at 560, where N may be decremented by one. At 562, processing of a next frame of the N frames may begin, with the voltage set to voltage_0 and the clamping threshold set to clamping_threshold_0. Processing of frames other than a first frame of N frames is denoted by the box designated as 564. At 566, it is determined whether the dynamic capacitance has remained above clamping_threshold_0 for more than the amount of time designated by "LIMIT". If not, and the end of frame is not detected, processing may remain at 566 until the "LIMIT" is exceeded or the end of frame is detected. If not, and the end of frame is detected, processing may continue at 571 where the clamping threshold is set to clamping_threshold_0 and the voltage is set to voltage_0, if not already. Processing may continue at 572 where N is decremented by one. At 574, it may be determined whether N has reached a value of zero. If not, processing may continue at 562 as the start of a next frame. If so, processing may continue back at 542 in FIG. 5A.

Referring back to 566, if the "LIMIT" has been exceeded, processing may continue at 568, where a request for increased voltage and clamping threshold may be requested from a driver and/or power control unit (PCU), where processing may remain until a response is received. Once a response is received, processing may continue at 570, where the clamping threshold may be increased to clamping_threshold_1 and the voltage may be increased to voltage_1 until the end of the frame. When the end of frame is detected, processing may continue at 571, where the clamping threshold is set to clamping_threshold_0 and the voltage is set to voltage_0. Processing may continue at 572, where N is decremented by one. At 574, it may be determined whether N has reached a value of zero. If not, processing may continue at 562 as the start of a next frame. If so, processing may continue back at 542 in FIG. 5A. Processing may continue in this way until the end of the graphics workload.

Figure 6:
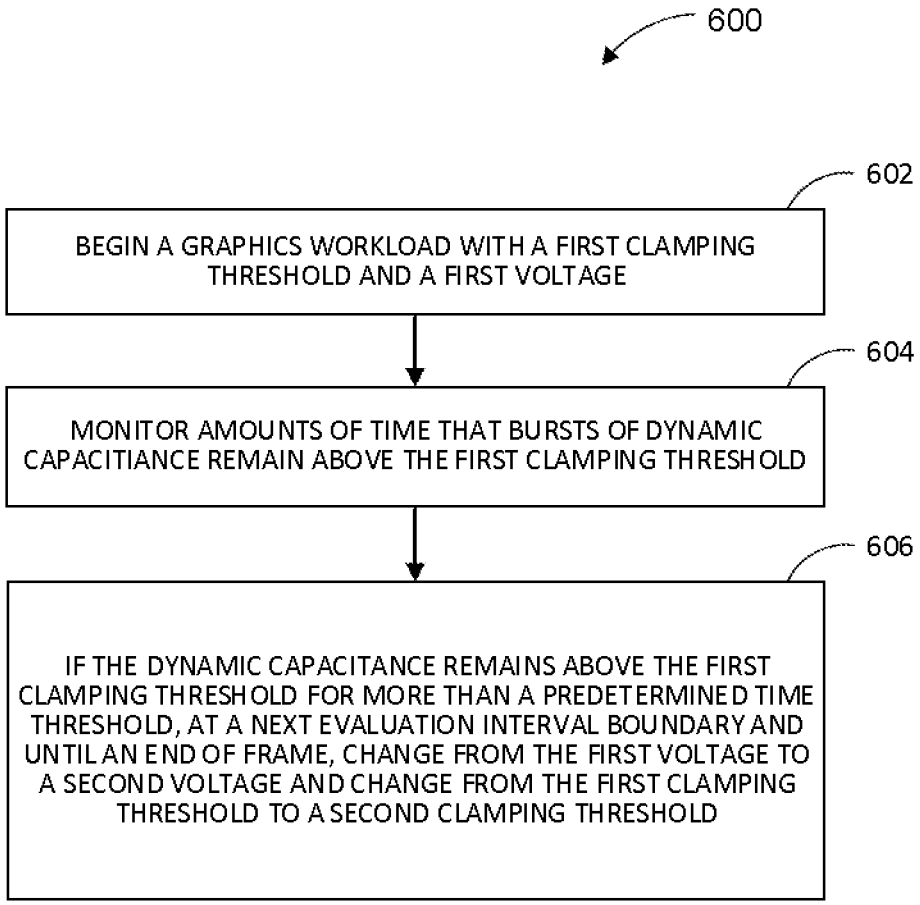
FIG. 6 is an example flow chart depicting a graphics load line optimization method, according to an embodiment.

An example to summarize a load line optimization feature in graphics processing may be found in flow chart 600 of FIG. 6, according to an embodiment. At 602, a graphics workload may be started with a voltage set to a first voltage and a clamping threshold set to a first clamping threshold. At 604, amounts of time that bursts of dynamic capacitance remain above the first clamping threshold may be determined. At 606, if the dynamic capacitance remains above the first clamping threshold for more than a predetermined time threshold, the voltage may be changed to a second voltage, and the clamping threshold may be changed to a second clamping threshold. In an embodiment, the second voltage and second clamping threshold may remain set until the end of the frame. In one embodiment, these values may be reset to the first voltage and the first clamping threshold at the beginning of the next frame. In an embodiment, if a number of clock cycles from a start of an initial frame to when the predetermined time threshold is exceeded is less than a predetermined minimum number of clock cycles, the second clamping threshold and the second voltage may be maintained for processing of a predetermined number of subsequent frames. In embodiments, settings for the voltage, clamping threshold, predetermined time threshold, and/or the predetermined minimum number of clock cycles may be factory set or programmable (e.g., settable in a hardware register, software driver, lookup table, etc.). The start/end of a frame may be detectable, for example by a driver.

Figure 7:
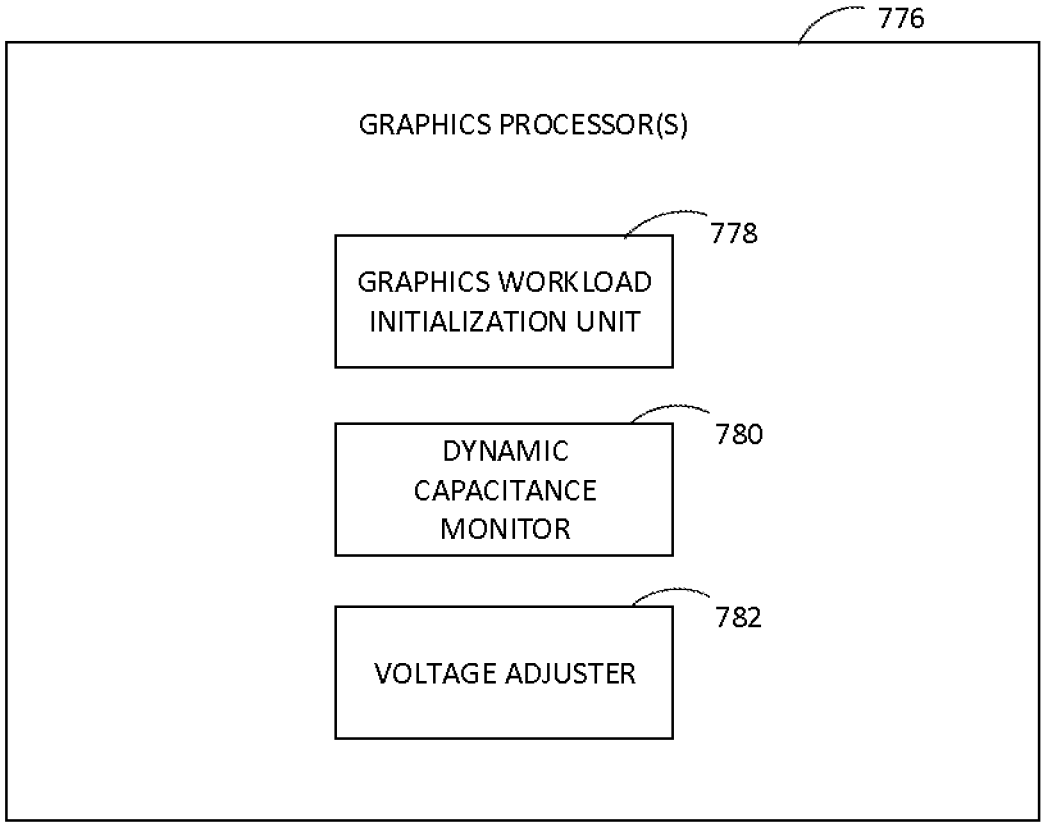
FIG. 7 is a block diagram of functional components of an example graphics processor, according to an embodiment.

FIG. 7 is a block diagram of functional components of an example graphics processor 776, according to an embodiment. In embodiments, each of the functional components of example graphics processor 776 may be implemented in hardware, software, firmware, or a combination. An example graphics processor 776 may include, for example, a graphics workload initialization unit 778, a dynamic capacitance monitor 780, and a voltage adjuster 782, which may execute the functions described above with reference to FIG. 5, for example. Graphics workload initialization unit 776 may set a voltage to a first voltage and set a clamping threshold to a first clamping threshold prior to starting a graphics workload. Dynamic capacitance monitor 780 may monitor amounts of time that bursts of dynamic capacitance remain above the first clamping threshold. In an embodiment, dynamic capacitance monitor 780 may include, for example, a comparison unit (not shown) that may compare values of dynamic capacitance to the first clamping threshold. Voltage adjuster 782 may adjust the voltage and clamping threshold based on the results provided by dynamic capacitance monitor 780 and possibly other factors.

One or more features disclosed herein may be implemented in hardware, software, firmware, and combinations thereof, including discrete and integrated circuit logic, application specific integrated circuit (ASIC) logic, and microcontrollers, and may be implemented as part of a domain-specific integrated circuit package, or a combination of integrated circuit packages. The terms software and firmware, as used herein, refer to a computer program product including at least one computer readable medium having computer program logic, such as computer-executable instructions, stored therein to cause a computer system to perform one or more features and/or combinations of features disclosed herein. The computer readable medium may be transitory or non-transitory. An example of a transitory computer readable medium may be a digital signal transmitted over a radio frequency or over an electrical conductor, through a local or wide area network, or through a network such as the Internet. An example of a non-transitory computer readable medium may be a compact disk, a flash memory, SRAM, DRAM, a hard drive, a solid state drive, or other data storage device.

Figure 8:
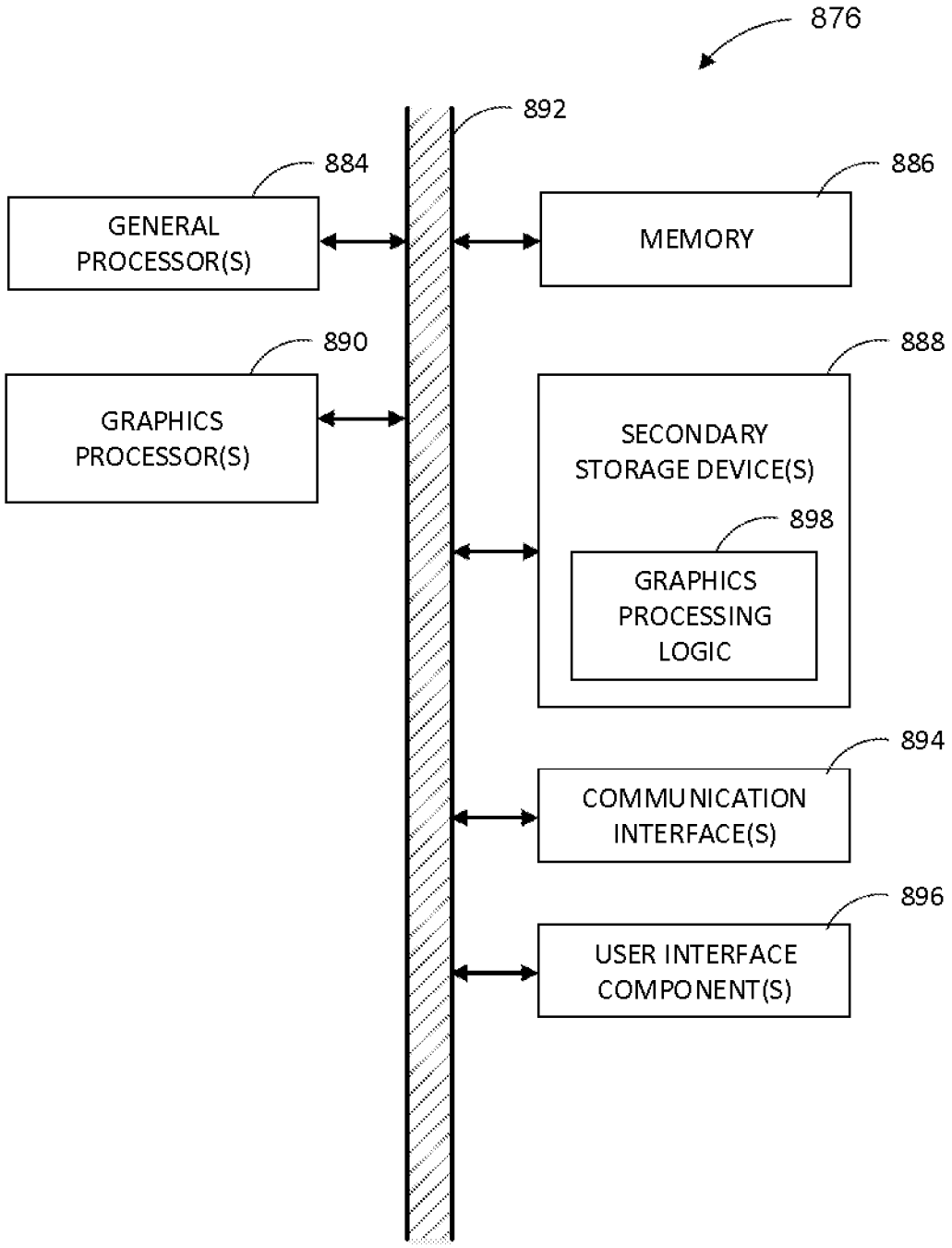
FIG. 8 is a block diagram of an example graphics processing device, according to an embodiment.

As stated above, in embodiments, some or all of the processing described herein may be implemented as hardware, software, and/or firmware. Such embodiments may be illustrated in the context of an example computing system 876 as shown in FIG. 8. Computing system 876 may include one or more central processing unit(s) (CPU), such as one or more general processors 884, connected to memory 886, one or more secondary storage devices 888, and one or more graphics processors 890 by a link 892 or similar mechanism. Alternatively, graphics processor(s) 890 may be integrated with general processor(s) 884. Graphics processor(s) 890 may include one or more logic units, such as those described with reference to FIG. 7, for example, for carrying out the methods described herein. In embodiments, other logic units may also be present. One skilled in the art would recognize that the functions of the logic units, such as logic units discussed with reference to FIG. 7 may be executed by a single logic unit, or any number of logic units. Computing system 876 may optionally include communication interface(s) 894 and/or user interface components 896. The communication interface(s) 894 may be implemented in hardware or a combination of hardware and software, and may provide a wired or wireless network interface to a network. The user interface components 896 may include, for example, a touchscreen, a display, one or more user input components (e.g., a keyboard, a mouse, etc.), a speaker, or the like, or any combination thereof. Graphics processed via the methods described herein may be displayed on one or more user interface components. The one or more secondary storage devices 888 may be, for example, one or more hard drives or the like, and may store logic 898 (e.g., application logic) to be executed by graphics processor(s) 890 and/or general processor(s) 884. In an embodiment, general processor(s) 884 and/or graphics processor(s) 890 may be microprocessors, and logic 898 may be stored or loaded into memory 886 for execution by general processor(s) 884 and/or graphics processor(s) 890 to provide the functions described herein. Note that while not shown, computing system 876 may include additional components.

Figure 9:
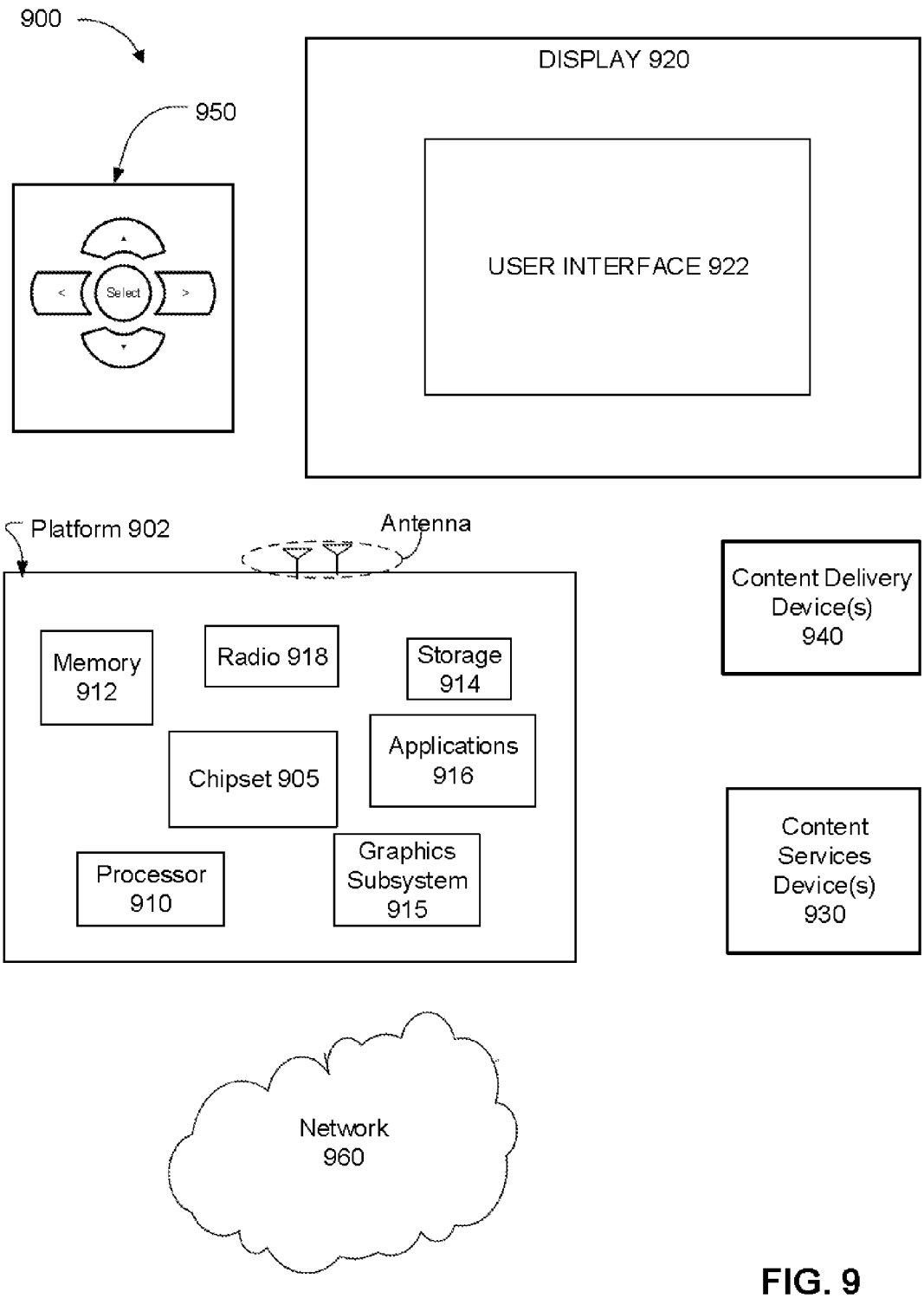
FIG. 9 illustrates an example information system in which an embodiment may be implemented.

The technology described above may be a part of a larger information system. FIG. 9 illustrates such an embodiment, as a system 900. In embodiments, system 900 may be a media system although system 900 is not limited to this context. For example, system 900 may be incorporated into a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

In embodiments, system 900 comprises a platform 902 coupled to a display 920. Platform 902 may receive content from a content device such as content services device(s) 930 or content delivery device(s) 940 or other similar content sources. A navigation controller 950 comprising one or more navigation features may be used to interact with, for example, platform 902 and/or display 920. Each of these components is described in more detail below.

In embodiments, platform 902 may comprise any combination of a chipset 905, processor 910, memory 912, storage 914, graphics subsystem 915, applications 916 and/or radio 918. Chipset 905 may provide intercommunication among processor 910, memory 912, storage 914, graphics subsystem 915, applications 916 and/or radio 918. For example, chipset 905 may include a storage adapter (not depicted) capable of providing intercommunication with storage 914.

Processor 910 may be implemented as Complex Instruction Set Computer (CISC) or Reduced Instruction Set Computer (RISC) processors, x86 instruction set compatible processors, multi-core, or any other microprocessor or central processing unit (CPU). In embodiments, processor 910 may comprise dual-core processor(s), dual-core mobile processor(s), and so forth.

Memory 912 may be implemented as a volatile memory device such as, but not limited to, a Random Access Memory (RAM), Dynamic Random Access Memory (DRAM), or Static RAM (SRAM).

Storage 914 may be implemented as a non-volatile storage device such as, but not limited to, a magnetic disk drive, optical disk drive, tape drive, an internal storage device, an attached storage device, flash memory, battery backed-up SDRAM (synchronous DRAM), and/or a network accessible storage device. In embodiments, storage 914 may comprise technology to increase the storage performance enhanced protection for valuable digital media when multiple hard drives are included, for example.

Graphics subsystem 915 may perform processing of images such as still or video for display. Graphics subsystem 915 may be a graphics processing unit (GPU) or a visual processing unit (VPU), for example. An analog or digital interface may be used to communicatively couple graphics subsystem 915 and display 920. For example, the interface may be any of a High-Definition Multimedia Interface, DisplayPort, wireless HDMI, and/or wireless HD compliant techniques. Graphics subsystem 915 could be integrated into processor 910 or chipset 905. Graphics subsystem 915 could be a stand-alone card communicatively coupled to chipset 905.

The graphics and/or video processing techniques described herein may be implemented in various hardware architectures. For example, graphics and/or video functionality may be integrated within a chipset. Alternatively, a discrete graphics and/or video processor may be used. As still another embodiment, the graphics and/or video functions may be implemented by a general purpose processor, including a multi-core processor. In a further embodiment, the functions may be implemented in a consumer electronics device.

Radio 918 may include one or more radios capable of transmitting and receiving signals using various suitable wireless communications techniques. Such techniques may involve communications across one or more wireless networks. Exemplary wireless networks include (but are not limited to) wireless local area networks (WLANs), wireless personal area networks (WPANs), wireless metropolitan area networks (WMANs), cellular networks, and satellite networks. In communicating across such networks, radio 918 may operate in accordance with one or more applicable standards in any version.

In embodiments, display 920 may comprise any television type monitor or display. Display 920 may comprise, for example, a computer display screen, touch screen display, video monitor, television-like device, and/or a television. Display 920 may be digital and/or analog. In embodiments, display 920 may be a holographic display. Also, display 920 may be a transparent surface that may receive a visual projection. Such projections may convey various forms of information, images, and/or objects. For example, such projections may be a visual overlay for a mobile augmented reality (MAR) application. Under the control of one or more software applications 916, platform 902 may display user interface 922 on display 920.

In embodiments, content services device(s) 930 may be hosted by any national, international and/or independent service and thus accessible to platform 902 via the Internet, for example. Content services device(s) 930 may be coupled to platform 902 and/or to display 920. Platform 902 and/or content services device(s) 930 may be coupled to a network 960 to communicate (e.g., send and/or receive) media information to and from network 960. Content delivery device(s) 940 also may be coupled to platform 902 and/or to display 920.

In embodiments, content services device(s) 930 may comprise a cable television box, personal computer, network, telephone, Internet enabled devices or appliance capable of delivering digital information and/or content, and any other similar device capable of unidirectionally or bidirectionally communicating content between content providers and platform 902 and/display 920, via network 960 or directly. It will be appreciated that the content may be communicated unidirectionally and/or bidirectionally to and from any one of the components in system 900 and a content provider via network 960. Examples of content may include any media information including, for example, video, music, medical and gaming information, and so forth.

Content services device(s) 930 receives content such as cable television programming including media information, digital information, and/or other content. Examples of content providers may include any cable or satellite television or radio or Internet content providers. The provided examples are not meant to limit embodiments of the invention.

In embodiments, platform 902 may receive control signals from navigation controller 950 having one or more navigation features. The navigation features of controller 950 may be used to interact with user interface 922, for example. In embodiments, navigation controller 950 may be a pointing device that may be a computer hardware component (specifically human interface device) that allows a user to input spatial (e.g., continuous and multi-dimensional) data into a computer. Many systems such as graphical user interfaces (GUI), and televisions and monitors allow the user to control and provide data to the computer or television using physical gestures, facial expressions, or sounds.

Movements of the navigation features of controller 950 may be echoed on a display (e.g., display 920) by movements of a pointer, cursor, focus ring, or other visual indicators displayed on the display. For example, under the control of software applications 916, the navigation features located on navigation controller 950 may be mapped to virtual navigation features displayed on user interface 922, for example. In embodiments, controller 950 may not be a separate component but integrated into platform 902 and/or display 920. Embodiments, however, are not limited to the elements or in the context shown or described herein.

In embodiments, drivers (not shown) may comprise technology to enable users to instantly turn on and off platform 902 like a television with the touch of a button after initial boot-up, when enabled, for example. Program logic may allow platform 902 to stream content to media adaptors or other content services device(s) 930 or content delivery device(s) 940 when the platform is turned "off." In addition, chipset 905 may comprise hardware and/or software support for 5.1 surround sound audio and/or high definition 7.1 surround sound audio, for example. Drivers may include a graphics driver for integrated graphics platforms. In embodiments, the graphics driver may comprise a peripheral component interconnect (PCI) Express graphics card.

In various embodiments, any one or more of the components shown in system 900 may be integrated. For example, platform 902 and content services device(s) 930 may be integrated, or platform 902 and content delivery device(s) 940 may be integrated, or platform 902, content services device(s) 930, and content delivery device(s) 940 may be integrated, for example. In various embodiments, platform 902 and display 920 may be an integrated unit. Display 920 and content service device(s) 930 may be integrated, or display 920 and content delivery device(s) 940 may be integrated, for example. These examples are not meant to limit the invention.

In various embodiments, system 900 may be implemented as a wireless system, a wired system, or a combination of both. When implemented as a wireless system, system 900 may include components and interfaces suitable for communicating over a wireless shared media, such as one or more antennas, transmitters, receivers, transceivers, amplifiers, filters, control logic, and so forth. An example of wireless shared media may include portions of a wireless spectrum, such as the RF spectrum and so forth. When implemented as a wired system, system 900 may include components and interfaces suitable for communicating over wired communications media, such as input/output (I/O) adapters, physical connectors to connect the I/O adapter with a corresponding wired communications medium, a network interface card (NIC), disc controller, video controller, audio controller, and so forth. Examples of wired communications media may include a wire, cable, metal leads, printed circuit board (PCB), backplane, switch fabric, semiconductor material, twisted-pair wire, co-axial cable, fiber optics, and so forth.

Platform 902 may establish one or more logical or physical channels to communicate information. The information may include media information and control information. Media information may refer to any data representing content meant for a user. Examples of content may include, for example, data from a voice conversation, videoconference, streaming video, electronic mail ("email") message, voice mail message, alphanumeric symbols, graphics, image, video, text and so forth. Data from a voice conversation may be, for example, speech information, silence periods, background noise, comfort noise, tones and so forth. Control information may refer to any data representing commands, instructions or control words meant for an automated system. For example, control information may be used to route media information through a system, or instruct a node to process the media information in a predetermined manner. The embodiments, however, are not limited to the elements or in the context shown or described in FIG. 9.

Figure 10:
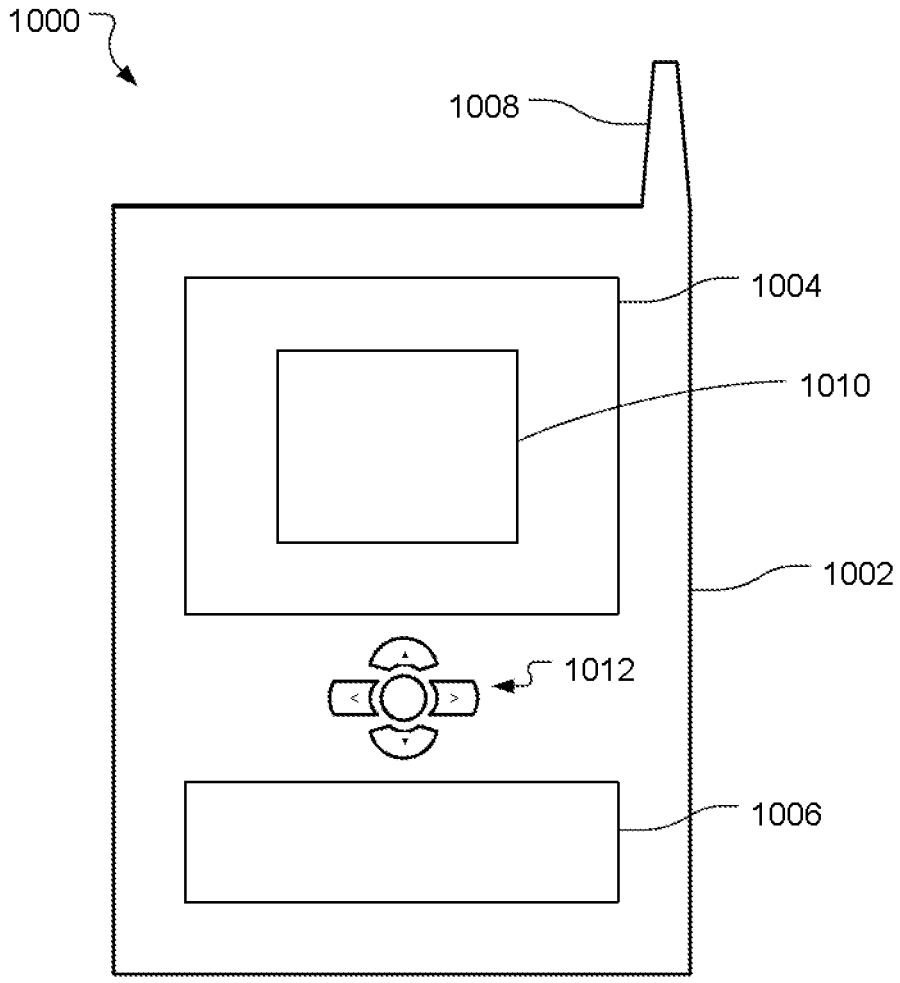
FIG. 10 illustrates an example mobile information device in which an embodiment may be implemented.

As described above, system 900 may be embodied in varying physical styles or form factors. FIG. 10 illustrates embodiments of a small form factor device 1000 in which system 900 may be embodied. In embodiments, for example, device 1000 may be implemented as a mobile computing device having wireless capabilities. A mobile computing device may refer to any device having a processing system and a mobile power source or supply, such as one or more batteries, for example.

As described above, examples of a mobile computing device may include a personal computer (PC), laptop computer, ultra-laptop computer, tablet, touch pad, portable computer, handheld computer, palmtop computer, personal digital assistant (PDA), cellular telephone, combination cellular telephone/PDA, television, smart device (e.g., smart phone, smart tablet or smart television), mobile internet device (MID), messaging device, data communication device, and so forth.

Examples of a mobile computing device also may include computers that are arranged to be worn by a person, such as a wrist computer, finger computer, ring computer, eyeglass computer, belt-clip computer, arm-band computer, shoe computers, clothing computers, and other wearable computers. In embodiments, for example, a mobile computing device may be implemented as a smart phone capable of executing computer applications, as well as voice communications and/or data communications. Although some embodiments may be described with a mobile computing device implemented as a smart phone by way of example, it may be appreciated that other embodiments may be implemented using other wireless mobile computing devices as well. The embodiments are not limited in this context.

As shown in FIG. 10, device 1000 may comprise a housing 1002, a display 1004, an input/output (I/O) device 1006, and an antenna 1008. Device 1000 also may comprise navigation features 1012. Display 1004 may comprise any suitable display unit for displaying information 1010 appropriate for a mobile computing device. I/O device 1006 may comprise any suitable I/O device for entering information into a mobile computing device. Examples for I/O device 1006 may include an alphanumeric keyboard, a numeric keypad, a touch pad, input keys, buttons, switches, rocker switches, microphones, speakers, voice recognition devices and software, and so forth. Information also may be entered into device 1000 by way of microphone. Such information may be digitized by a voice recognition device. The embodiments are not limited in this context.

Various embodiments may be implemented using hardware elements, software elements, or a combination of both. Examples of hardware elements may include processors, microprocessors, circuits, circuit elements (e.g., transistors, resistors, capacitors, inductors, and so forth), integrated circuits, application specific integrated circuits (ASIC), programmable logic devices (PLD), digital signal processors (DSP), field programmable gate array (FPGA), logic gates, registers, semiconductor device, chips, microchips, chip sets, and so forth. Examples of software may include software components, programs, applications, computer programs, application programs, system programs, machine programs, operating system software, middleware, firmware, software modules, routines, subroutines, functions, methods, procedures, software interfaces, application program interfaces (API), instruction sets, computing code, computer code, code segments, computer code segments, words, values, symbols, or any combination thereof. Determining whether an embodiment is implemented using hardware elements and/or software elements may vary in accordance with any number of factors, such as desired computational rate, power levels, heat tolerances, processing cycle budget, input data rates, output data rates, memory resources, data bus speeds and other design or performance constraints.

One or more aspects of at least one embodiment may be implemented by representative instructions stored on a machine-readable medium which represents various logic within the processor, which when read by a machine causes the machine to fabricate logic to perform the techniques described herein. Such representations, known as "IP cores" may be stored on a tangible, machine readable medium and supplied to various customers or manufacturing facilities to load into the fabrication machines that actually make the logic or processor.

Technologies disclosed herein leverage dynamic capacitance clamping to greatly improve graphics performance and power usage. The solutions provided herein allow for aggressive clamping at the start of a frame when the probability is high that graphics activity is low. Once the workload activity increases to above a level and is sustained, the voltage may be increased and less aggressive clamping may be used. Running at a lower voltage level for a dynamic initial portion of a frame greatly improves power-performance efficiency. The particular examples and scenarios used in this document are for ease of understanding and are not to be limiting. Features described herein may be used in many other contexts, as would be understood by one of ordinary skill in the art. For example, concepts described herein may be applied to a central processing unit (CPU).

There are various advantages of using the technologies described herein. One advantage is the improvement in power-performance efficiency over previous solutions. The solutions described herein use intra-frame knowledge of a workload's activity behavior to make power-saving decisions. Previous solutions do not leverage this knowledge in this way. Many other advantages may also be contemplated.

The following examples pertain to further embodiments.

Example 1 may include a graphics processing system, comprising: a graphics workload initialization unit configured to begin a graphics workload with a voltage set to a first voltage and a clamping threshold set to a first clamping threshold, wherein the clamping threshold is a minimum level of dynamic capacitance for which duration of sustained dynamic capacitance above the clamping threshold is monitored; a dynamic capacitance monitor configured to monitor amounts of time that bursts of dynamic capacitance remain above the first clamping threshold; and a voltage adjuster configured to, if the dynamic capacitance remains above the first clamping threshold for more than a predetermined time threshold, at a next evaluation interval boundary and until an end of frame, set the voltage to a second voltage and set the clamping threshold to a second clamping threshold.

Example 2 may include the subject matter of Example 1, wherein the voltage adjuster is further configured to, if the dynamic capacitance remains above the first clamping threshold for more than the predetermined time threshold: send a request to a control unit to change from the first voltage to the second voltage, and await a response from the control unit prior to changing from the first clamping threshold to the second clamping threshold.

Example 3 may include the subject matter of Example 1 or Example 2, wherein values for the first and second voltages and first and second clamping thresholds are programmable and each located in one or more of a hardware register, a software driver, or a lookup table, that are accessible by the graphics processor.

Example 4 may include the subject matter of any one of Examples 1-3, wherein the voltage adjuster is further configured to, at the end of an initial frame, if a number of clock cycles from a start of the initial frame to when the predetermined time threshold is exceeded is less than a predetermined minimum number of clock cycles, maintain the second clamping threshold and the second voltage for processing of a predetermined number of subsequent frames.

Example 5 may include the subject matter of any one of Examples 1-3, wherein the voltage adjuster is further configured to, at the end of the frame, change from the second voltage to the first voltage and change from the second clamping threshold to the first clamping threshold prior to processing continuing at a next frame.

Example 6 may include the subject matter of Example 5, wherein the dynamic capacitance monitor and voltage adjuster are further configured to, at the end of an initial frame, if a number of clock cycles from a start of the initial frame to when the predetermined time threshold is exceeded is not less than a predetermined minimum number of clock cycles, continue graphics processing for a predetermined number of subsequent frames with adjustments as necessary by the voltage adjuster.

In Example 7, any one of Examples 1-6 may optionally include a processor; a communication interface in communication with the processor and a network; a memory in communication with the processor; a user interface including a navigation device and display, the user interface in communication with the processor; and storage that stores application logic, the storage in communication with the processor, wherein the processor is configured to load the application logic from the storage into the memory and execute the application logic, wherein the execution of the application logic includes presenting graphics via the user interface.

Example 8 may include at least one computer program product for graphics processing, including at least one computer readable medium having computer program logic stored therein, the computer program logic including: logic to cause a processor to begin a graphics workload with a voltage set to a first voltage and a clamping threshold set to a first clamping threshold, wherein the clamping threshold is a minimum level of dynamic capacitance for which duration of sustained dynamic capacitance above the clamping threshold is monitored; logic to cause the processor to monitor amounts of time that bursts of dynamic capacitance remain above the first clamping threshold; and logic to cause the processor to, if the dynamic capacitance remains above the first clamping threshold for more than a predetermined time threshold, at a next evaluation interval boundary and until an end of frame, set the voltage to a second voltage and set the clamping threshold to a second clamping threshold.

Example 9 may include the subject matter of Example 8, wherein the logic to set the voltage to the second voltage and set the clamping threshold to the second clamping threshold further includes logic to, if the dynamic capacitance remains above the first clamping threshold for more than the predetermined time threshold: send a request to a control unit to change from the first voltage to the second voltage; and await a response from the control unit prior to changing from the first clamping threshold to the second clamping threshold.

Example 10 may include the subject matter of Example 8 or Example 9, wherein values for the first and second voltages and first and second clamping thresholds are programmable.

Example 11 may include the subject matter of any one of Examples 8-10, wherein the logic to set the voltage to the second voltage and set the clamping threshold to the second clamping threshold further includes logic to, at the end of an initial frame, if a number of clock cycles from a start of the initial frame to when the predetermined time threshold is exceeded is less than a predetermined minimum number of clock cycles, maintain the second clamping threshold and the second voltage for processing of a predetermined number of subsequent frames.

Example 12 may include the subject matter of any one of Examples 8-10, wherein the logic to set the voltage to the second voltage and set the clamping threshold to the second clamping threshold further includes logic to, at the end of the frame, change from the second voltage to the first voltage and change from the second clamping threshold to the first clamping threshold prior to processing continuing at a next frame.

Example 13 may include the subject matter of Example 12, wherein the logic to monitor amounts of time that bursts of dynamic capacitance remain above the first clamping threshold and the logic to set the voltage to the second voltage and set the clamping threshold to the second clamping threshold each further include logic to, at the end of an initial frame, if a number of clock cycles from a start of the initial frame to when the predetermined threshold is exceeded is not less than a predetermined minimum number of clock cycles, continue graphics processing for a predetermined number of subsequent frames with adjustments to the voltage and the clamping threshold as necessary.

Example 14 may include an apparatus for graphics processing, comprising: means for beginning a graphics workload with a voltage set to a first voltage and a clamping threshold set to a first clamping threshold, wherein the clamping threshold is a minimum level of dynamic capacitance for which duration of sustained dynamic capacitance above the clamping threshold is monitored; means for monitoring amounts of time that bursts of dynamic capacitance remain above the first clamping threshold; and means for, if the dynamic capacitance remains above the first clamping threshold for more than a predetermined time threshold, at a next evaluation interval boundary and until an end of frame, setting the voltage to a second voltage and setting the clamping threshold to a second clamping threshold.

Example 15 may include the subject matter of Example 14, wherein the means for setting the voltage to the second voltage and setting the clamping threshold to the second clamping threshold further includes, if the dynamic capacitance remains above the first clamping threshold for more than the predetermined time threshold: means for sending a request to a control unit to change from the first voltage to the second voltage; and means for awaiting a response from the control unit prior to changing from the first clamping threshold to the second clamping threshold.

Example 16 may include the subject matter of Example 14 or Example 15, wherein values for the first and second voltages and first and second clamping thresholds are programmable.

Example 17 may include the subject matter of any one of Examples 14-16, wherein the means for setting the voltage to the second voltage and setting the clamping threshold to the second clamping threshold further includes means for, at the end of an initial frame, if a number of clock cycles from a start of the initial frame to when the predetermined time threshold is exceeded is less than a predetermined minimum number of clock cycles, maintaining the second clamping threshold and the second voltage for processing of a predetermined number of subsequent frames.

Example 18 may include the subject matter of any one of Examples 14-16, wherein the means for setting the voltage to the second voltage and setting the clamping threshold to the second clamping threshold further includes means for, at the end of the frame, changing from the second voltage to the first voltage and changing from the second clamping threshold to the first clamping threshold prior to processing continuing at a next frame.

Example 19 may include the subject matter of Example 18, wherein the means for monitoring amounts of time that bursts of dynamic capacitance remain above the first clamping threshold and the means for setting the voltage to the second voltage and setting the clamping threshold to the second clamping threshold each include means for, at the end of an initial frame, if a number of clock cycles from a start of the initial frame to when the predetermined time threshold is exceeded is not less than a predetermined minimum number of clock cycles, continuing graphics processing for a predetermined number of subsequent frames with adjustments to the voltage and the clamping threshold as necessary.

Example 20 may include a method of graphics processing, comprising: beginning, by a graphics processor, a graphics workload with a voltage set to a first voltage and a clamping threshold set to a first clamping threshold, wherein the clamping threshold is a minimum level of dynamic capacitance for which duration of sustained dynamic capacitance above the clamping threshold is monitored; monitoring, by the graphics processor, amounts of time that bursts of dynamic capacitance remain above the first clamping threshold; and if the dynamic capacitance remains above the first clamping threshold for more than a predetermined time threshold, at a next evaluation interval boundary and until an end of frame, setting the voltage to a second voltage and setting the clamping threshold to a second clamping threshold.

Example 21 may include the subject matter of Example 20, wherein the setting includes, if the dynamic capacitance remains above the first clamping threshold for more than the predetermined time threshold: sending a request to a control unit to change from the first voltage to the second voltage; and awaiting a response from the control unit prior to changing from the first clamping threshold to the second clamping threshold.

Example 22 may include the subject matter of Example 20 or Example 21, wherein values for the first and second voltages and first and second clamping thresholds are programmable.

Example 23 may include the subject matter of any one of Examples 20-22, wherein the setting includes, at the end of an initial frame, if a number of clock cycles from a start of the initial frame to when the predetermined time threshold is exceeded is less than a predetermined minimum number of clock cycles, maintaining the second clamping threshold and the second voltage for processing of a predetermined number of subsequent frames.

Example 24 may include the subject matter of any one of Examples 20-22, wherein the setting includes, at the end of the frame, changing from the second voltage to the first voltage and changing from the second clamping threshold to the first clamping threshold prior to processing continuing at a next frame.

In Example 25, Example 24 may optionally include at the end of an initial frame, if a number of clock cycles from a start of the initial frame to when the predetermined threshold is exceeded is not less than a predetermined minimum number of clock cycles, continuing graphics processing for a predetermined number of subsequent frames with adjustments to the voltage and the clamping threshold as necessary.

Example 26 may include at least one machine readable medium comprising a plurality of instructions that in response to being executed on a computing device, cause the computing device to carry out a method according to any one of Examples 20-25.

Example 27 may include an apparatus configured to perform the method of any one of Examples 20-25.

Example 28 may include a computer system to perform the method of any one of Examples 20-25.

Examples 29 may include a machine to perform the method of any one of Examples 20-25.

Example 30 may include an apparatus comprising means for performing the method of any one of Examples 20-25.

Example 31 may include a computing device comprising memory and a chipset configured to perform the method of any one of Examples 20-25.

Methods and systems are disclosed herein with the aid of functional building blocks illustrating the functions, features, and relationships thereof. At least some of the boundaries of these functional building blocks have been arbitrarily defined herein for the convenience of the description. Alternate boundaries may be defined so long as the specified functions and relationships thereof are appropriately performed.

While various embodiments are disclosed herein, it should be understood that they have been presented by way of example only, and not limitation. It will be apparent to persons skilled in the relevant art that various changes in form and detail may be made therein without departing from the scope of the methods and systems disclosed herein. Thus, the breadth and scope of the claims should not be limited by any of the exemplary embodiments disclosed herein.

As used in this application and in the claims, a list of items joined by the term "one or more of" can mean any combination of the listed terms. For example, the phrases "one or more of A, B or C" and "one or more of A, B, and C" can mean A; B; C; A and B; A and C; B and C; or A, B and C.

What is claimed is:

1. An apparatus, comprising a graphics processor and memory configured to:

set a voltage of the graphics processor to a first voltage and set a dynamic capacitance threshold of a clamping mechanism of the graphics processor to a first dynamic capacitance threshold at a start of a first frame;

compare a measure of dynamic capacitance of the graphics processor to the first dynamic capacitance threshold during processing of the first frame;

activate the clamping mechanism of the graphics processor if the measure of dynamic capacitance exceeds the first dynamic capacitance threshold during processing of the first frame; and increase the voltage of the graphics processor to a second voltage and increase the dynamic capacitance threshold to a second dynamic capacitance threshold, during processing of the first frame, if the measure of dynamic capacitance exceeds the first dynamic capacitance threshold for a predetermined duration of time during processing of the first frame.

2. The apparatus of claim 1, wherein the graphics processor is further configured to:

request a voltage controller to increase the voltage of the graphics processor to the second voltage, and increase the dynamic capacitance threshold to the second dynamic capacitance threshold after the voltage controller responds to the request, if the measure of dynamic capacitance exceeds the first dynamic capacitance threshold for the predetermined duration of time during processing of the first frame.

3. The apparatus of claim 1, wherein the graphics processor is further configured to retrieve values for the first and second voltages and retrieve the first and second dynamic capacitance thresholds from one or more of a hardware register, a software driver, and a lookup table.

4. The apparatus of claim 1, wherein the graphics processor is further configured to:

maintain the voltage of the graphics processor at the second voltage and the dynamic capacitance threshold at the second dynamic capacitance threshold during processing of a second frame if the measure of dynamic capacitance exceeds the first dynamic capacitance threshold for the predetermined duration of time within a predetermined number of clock cycles of a start of the first frame; and reset the voltage of the graphics processor to the first voltage and resent the dynamic capacitance threshold to the first dynamic capacitance threshold at a start of the second frame if the measure of dynamic capacitance does not exceed the first dynamic capacitance threshold for the predetermined duration of time within the predetermined number of clock cycles of the start of the first frame.

5. The apparatus of claim 1, wherein the graphics processor is further configured to:

select a number of frames based on a workload of the graphics processor, wherein the selected frames include the first frame and one or more frames subsequent to the first frame;

set a bit if the measure of dynamic capacitance exceeds the first dynamic capacitance threshold for the predetermined duration of time within a predetermined number of clock cycles of a start of the first frame; and for each subsequent selected frame for which the bit is not set prior to the start of the respective frame, maintain the voltage of the graphics processor at the second voltage and maintain the dynamic capacitance threshold at the second dynamic capacitance threshold during processing of the subsequent frame if the bit is set prior to the start of the subsequent frame.

6. The apparatus of claim 5, wherein the graphics processor is further configured to, for each subsequent frame for which the bit is not set prior to the start of the respective frame:

set the voltage of the graphics processor to the first voltage and set the dynamic capacitance threshold to the first dynamic capacitance threshold a start of the subsequent frame;

increase the voltage of the graphics processor to the second voltage and increase the dynamic capacitance threshold to the second dynamic capacitance threshold during processing of the subsequent frame if the measure of dynamic capacitance exceeds the first dynamic capacitance threshold for the predetermined duration of time during the processing of the subsequent frame; and set the bit if the measure of dynamic capacitance exceeds the first dynamic capacitance threshold for the predetermined duration of time within the predetermined number of clock cycles of the start of the subsequent frame.

7. The apparatus of claim 1, further including:

a processor and memory;

communication device to interface between the processor and a communication network; and a user interface to interface between a user and one or more of the processor and the communication device;

wherein the processor and memory are configured to execute an application; and wherein the graphics processor is configured to present graphics of the application at a display of the user interface.

8. A non-transitory computer readable medium encoded with a computer program that includes instructions to cause a graphics processor to:

set a voltage of the graphics processor to a first voltage and set a dynamic capacitance threshold of a clamping mechanism of the graphics processor to a first dynamic capacitance threshold at a start of a first frame;

compare a measure of dynamic capacitance of the graphics processor to the first dynamic capacitance threshold during processing of the first frame;

activate the clamping mechanism of the graphics processor if the measure of dynamic capacitance exceeds the first dynamic capacitance threshold during processing of the first frame; and increase the voltage of the graphics processor to a second voltage and increase the dynamic capacitance threshold to a second dynamic capacitance threshold, during processing of the first frame, if the measure of dynamic capacitance exceeds the first dynamic capacitance threshold for a predetermined duration of time during processing of the first frame.

9. The non-transitory computer readable medium of claim 8, further including instructions to cause the graphics processor to:

request a voltage controller to increase the voltage of the graphics processor to the second voltage, and increase the dynamic capacitance to the second the dynamic capacitance threshold after the voltage controller response to the request, if the measure of dynamic capacitance exceeds the first dynamic capacitance threshold for the predetermined duration of time during processing of the first frame.

10. The non-transitory computer readable medium of claim 8, further including instructions to cause the graphics processor to retrieve values for the first and second voltages and retrieve the first and second dynamic capacitance thresholds from one or more of a hardware register, a software driver, and a lookup table.

11. The non-transitory computer readable medium of claim 8, further including instructions to cause the graphics processor to:

maintain the voltage of the graphics processor at the second voltage and the dynamic capacitance threshold at the second dynamic capacitance threshold during processing of a second frame if the measure of dynamic capacitance exceeds the first dynamic capacitance threshold for the predetermined duration of time within a predetermined number of clock cycles of a start of the first frame; and reset the voltage of the graphics processor to the first voltage and resent the dynamic capacitance threshold to the first dynamic capacitance threshold at a start of the second frame if the measure of dynamic capacitance does not exceed the first dynamic capacitance threshold for the predetermined duration of time within the predetermined number of clock cycles of the start of the first frame.

12. The non-transitory computer readable medium of claim 8, further including instructions to cause the graphics processor to:

select a number of frames based on a workload of the graphics processor, wherein the selected frames include the first frame and one or more frames subsequent to the first frame;

set a bit if the measure of dynamic capacitance exceeds the first dynamic capacitance threshold for the predetermined duration of time within a predetermined number of clock cycles of a start of the first frame; and for each subsequent selected frame for which the bit is not set prior to the start of the respective frame, maintain the voltage of the graphics processor at the second voltage and maintain the dynamic capacitance threshold at the second dynamic capacitance threshold during processing of the subsequent frame if the bit is set prior to the start of the subsequent frame.

13. The non-transitory computer readable medium of claim 12, further including instructions to cause the graphics processor to, for each subsequent selected frame for which the bit is not set prior to the start of the respective frame:

set the voltage of the graphics processor to the first voltage and set the dynamic capacitance threshold to the first dynamic capacitance threshold a start of the subsequent frame;

increase the voltage of the graphics processor to the second voltage and increase the dynamic capacitance threshold to the second dynamic capacitance threshold during processing of the subsequent frame if the measure of dynamic capacitance exceeds the first dynamic capacitance threshold for the predetermined duration of time during the processing of the subsequent frame; and set the bit if the measure of dynamic capacitance exceeds the first dynamic capacitance threshold for the predetermined duration of time within the predetermined number of clock cycles of the start of the subsequent frame.

14. A method of graphics processing, comprising:

setting a voltage of a graphics processor to a first voltage and setting a dynamic capacitance threshold of a clamping mechanism of the graphics processor to a first dynamic capacitance threshold at a start of a first frame;

comparing a measure of dynamic capacitance of the graphics processor to the first dynamic capacitance threshold during processing of the first frame;

activating the clamping mechanism of the graphics processor if the measure of dynamic capacitance exceeds the first dynamic capacitance threshold during processing of the first frame; and increasing the voltage of the graphics processor to a second voltage and the dynamic capacitance threshold to a second dynamic capacitance threshold, during processing of the first frame, if the measure of dynamic capacitance exceeds the first dynamic capacitance threshold for a predetermined duration of time during processing of the first frame.

15. The method of claim 14, wherein the increasing includes;

requesting a voltage controller to increase the voltage of the graphics processor to the second voltage, and increasing the dynamic capacitance threshold to the second dynamic capacitance threshold after the voltage controller response to the request, if the measure of dynamic capacitance exceeds the first dynamic capacitance threshold for the predetermined duration of time during processing of the first frame.

16. The method of claim 14, further including:

retrieving values for the first and second voltages and retrieve the first and second dynamic capacitance thresholds from one or more of a hardware register, a software driver, and a lookup table.

17. The method of claim 14, further including:

maintaining the voltage of the graphics processor at the second voltage and the dynamic capacitance threshold at the second dynamic capacitance threshold during processing of a second frame if the measure of dynamic capacitance exceeds the first dynamic capacitance threshold for the predetermined duration of time within a predetermined number of clock cycles of a start of the first frame; and resetting the voltage of the graphics processor to the first voltage and the dynamic capacitance threshold to the first dynamic capacitance threshold at a start of the second frame if the measure of dynamic capacitance does not exceed the first dynamic capacitance threshold for the predetermined duration of time within the predetermined number of clock cycles of the start of the first frame.

18. The method of claim 14, further including:

selecting a number of frames based on a workload of the graphics processor, wherein the selected frames include the first frame and one or more frames subsequent to the first frame;

setting a bit if the measure of dynamic capacitance exceeds the first dynamic capacitance threshold for the predetermined duration of time within a predetermined number of clock cycles of a start of the first frame; and for each subsequent selected frame for which the bit is not set prior to the start of the respective frame, maintaining the voltage of the graphics processor at the second voltage and the dynamic capacitance threshold at the second dynamic capacitance threshold during processing of the subsequent frame if the bit is set prior to the start of the subsequent frame.

19. The method of claim 18, further comprising, for each subsequent frame for which the bit is not set prior to the start of the respective frame:

setting the voltage of the graphics processor to the first voltage and set the dynamic capacitance threshold to the first dynamic capacitance threshold a start of the subsequent frame;

increasing the voltage of the graphics processor to the second voltage and increase the dynamic capacitance threshold to the second dynamic capacitance threshold during processing of the subsequent frame if the measure of dynamic capacitance exceeds the first dynamic capacitance threshold for the predetermined duration of time during the processing of the subsequent frame; and setting the bit if the measure of dynamic capacitance exceeds the first dynamic capacitance threshold for the predetermined duration of time within the predetermined number of clock cycles of the start of the subsequent frame.

* * * * *